US005915883A

United States Patent [19]

Kuehn

[11] Patent Number: 5,915,883

[45] Date of Patent: Jun. 29, 1999

[54] SUBMERSIBLE DRIVE UNIT FOR USE WITH UNDERWATER PILE DRIVERS AND WORK UNITS

[76] Inventor: Hans Kuehn, Tierparkallee 27, D-22527 Hamburg, Germany

[21] Appl. No.: 08/481,272

[22] PCT Filed: Jan. 3, 1994

[86] PCT No.: PCT/DE94/00001

§ 371 Date: Jul. 3, 1995

§ 102(e) Date: Jul. 3, 1995

[87] PCT Pub. No.: WO94/16152

PCT Pub. Date: Jul. 21, 1994

[30] Foreign Application Priority Data

Jan. 5, 1993 [DE] Germany ..... 43 00 073

[51] Int. Cl.[6] ..... E02D 7/02; E02D 9/00

[52] U.S. Cl. ..... 405/228; 405/191; 405/232

[58] Field of Search ..... 405/228, 232, 405/231, 227, 190, 191; 173/DIG. 1; 166/338, 341–343

[56] References Cited

U.S. PATENT DOCUMENTS

| | | | |
|---|---|---|---|
| 3,314,240 | 4/1967 | Bardgette . | |
| 3,354,658 | 11/1967 | Leonardi . | |
| 3,520,358 | 7/1970 | Brooks et al. | 166/5 |
| 3,550,386 | 12/1970 | Ballinger . | |
| 3,998,064 | 12/1976 | Jansz . | |
| 4,157,287 | 6/1979 | Christenson | 204/180 R |
| 4,502,407 | 3/1985 | Stevens | 114/222 |
| 4,618,285 | 10/1986 | Aslstone | 405/191 |
| 4,721,055 | 1/1988 | Pado | 114/330 |
| 4,817,734 | 4/1989 | Kuehn | 173/228 X |
| 4,872,514 | 10/1989 | Kuehn | 405/228 X |
| 4,921,438 | 5/1990 | Godfrey et al. | 439/190 |
| 5,052,941 | 10/1991 | Hernandez-Marti et al. | 439/194 |
| 5,074,713 | 12/1991 | Salvi dos Reis | 405/169 |
| 5,092,711 | 3/1992 | Langner | 405/169 |
| 5,145,007 | 9/1992 | Dinkins | 166/386 |
| 5,209,673 | 5/1993 | Mohn | 439/199 |
| 5,370,545 | 12/1994 | Laurent | 439/190 |

FOREIGN PATENT DOCUMENTS

| | | | |
|---|---|---|---|
| 8301622 | 9/1983 | Netherlands | 405/228 |

*Primary Examiner*—Dennis L. Taylor
*Attorney, Agent, or Firm*—Whyte Hirschboeck Dudek S.C.

[57] ABSTRACT

Submersible driving units with hydraulic pumps driven by underwater electric motors and linked to a hydraulic medium reservoir which may be connected to the driving mechanism of underwater ramming machinery and tools require a frame upon which the above-mentioned components of the driving units can be secured. This makes the driving unit heavy, costly to produce and difficult to exchange. A new embodiment allows a less costly design without a frame. At least one underwater electric motor (2), a hydraulic pump (3) and a hydraulic medium reservoir (4) are assembled into a self-contained, light, compact, autonomous and easy-to-exchange driving unit (1) which may be connected to further corresponding driving units (1), forming a large driving unit. In order to connect it to the driving mechanism of the ramming machinery or tools (21, 33, 36), the driving unit (1) is further provided with couplings (12; 13) for connecting in an easily detachable manner at least one hydraulic medium-transmitting linking element (46,26). The hydraulic medium reservoir (4) carrier all driving components (2,3,4) and coupling elements (46, 26).

26 Claims, 4 Drawing Sheets

27,31
20
20
43
2
2
41
42
1
1
4
4
12
13
42
41
13
12

27
1
1
4
4
13
13
75
76
12
12
72
71
74
46
73
57
56
21,33,36
26
59
58

20
70
17
1
17
13
12
56
57
54
60
69
55
60
61
68
57
64
62
26
67
59
58
65
63
17
40
66
21,33,36

17
1
62
54
47
26
61
55
48
21,33,36

SUBMERSIBLE DRIVE UNIT FOR USE WITH UNDERWATER PILE DRIVERS AND WORK UNITS

This application is a 371 of PCT/DE94/00001, filed on Jan. 3, 1994.

BACKGROUND OF THE INVENTION

The invention deals with a submersible drive unit with pressure medium pumps connected with a pressure medium tank and driven by underwater electric motors, connectable with the drive of submersible pile drivers and work units.

For underwater pile driving on the sea floor, the pressure medium required for driving the equipment is supplied through a pressure medium circuit with long hoses from above the water surface to the work unit. Because of the flow resistance in the hoses, this is only feasible up to a water depth where the pressure medium pumps can still cope with the additional pressure required to overcome this resistance. Finally, the limits of feasibility, economy and also handling are reached.

In this case a submersible drive unit is connected with the equipment and lowered together with it, supplying a pressure medium through a short circuit, while, for the operation of the drive unit, electric energy is supplied through a long electric power cable from above the water surface with now much lower resistance, i.e. energy losses.

DE-PS 24 54 521 discloses a drive unit, consisting of pressure medium pumps, each driven by an electric motor, and a tank containing the pressure medium, and is displaceable in upward and downward directions by shock absorbing means, and is guided on the pressure medium cylinder of a rammer projecting from the upper end of the housing of a ramming device, and is connected with the latter through short and flexible lines.

This known drive unit requires a precise form fit to the upper end of the ramming device, a shock absorbing displaceable guide at the ramming device, and an attachment to the latter through shock absorbing means, by means of bolts or similar fasteners.

The underwater drive unit currently in use shows especially the following disadvantages:

- the manufacture of machined surfaces on the relatively large parts required for a displaceable guide is expensive, and these surfaces are difficult to repair when damaged,
- the structure for guiding and supporting all components is heavy and relatively expensive,
- the firm connection with the ramming device can only be disconnected on the deck of the support ship, which requires correspondingly long repair and/or changeover times,
- the design is not conducive to the replacement of individual components,
- there is no quick access to the drive unit of the ramming device in case of damage.

Further, EP-PS 03 01 116 discloses an underwater drive unit comprising electric motors, pumps and pressure medium tank, which is connected with the drive of a pile driver or work unit by means of flexible conduits.

This drive unit has a cover housing with a concentric shaft which goes all the way through to accommodate a foundation pile or the necessary installation equipment, lower and upper support plates which are connected with the outer wall whose internal surface and the inner wall enclosing the shaft form an annulus in which electric motor/pump units are arranged parallel to the shaft. These electric motor/pump units are restrained by springs to limit and cushion movements relative to the cover housing and parallel to the shaft.

This design has disadvantages also. Considerable work time on the deck of the support ship is required in order to separate the drive unit from the work unit and to remove it from the shaft. Moreover, the cover housing, serving both as a guide and as a structure for attaching drive unit components is heavy and expensive, because of the inner and outer walls and the upper and lower support plates.

Apart from the need to eliminate these disadvantages, there are difficulties regarding economy and safety due to the overall configuration and working conditions of pile drivers and work units. They pertain to handling methods, outfitting expenditure, better utilization of the drive unit and its individual components.

As to handling, difficulties occur frequently with the umbilical which connects the support ship with the drive unit/work unit. This umbilical contains electric power cables for the transmission of drive energy to the underwater electric motors of the drive unit and at least one line for the supply of compressed air to the work unit to compensate for the outer pressure on enclosed hollow spaces, and control lines for controlling and monitoring the drive unit and work unit. All these lines are contained in one conduit only, the umbilical, so that one need only handle one line.

The umbilical is equipped with a strong outer armor to protect the internal lines and to bear lifting loads. It can cost up to US $1400.00 per meter. Fear of damage discourages its use.

The above mentioned difficulties arise, because the pile driver or work unit is rigidly attached to the drive unit to which the umbilical is rigidly attached, and because these parts must always be handled together and moved in unison when picked up on deck, during lowering to the pile deep underwater, and when laid down on deck. Because of rough handling the umbilical can hook on, twist around and catch on any object on deck, on the underwater structure or on the drive unit or on the work unit itself. The result of these difficulties is damage.

The costs for the heavy umbilical with hoist and pile driver/drive unit are further increased because, for fear of failure of lines inside the umbilical and/or motor/pump units, additional electric power cables and control lines are included in the umbilical and the drive unit is equipped with additional or bigger motor/pump units than required. This is done because, when such a failure occurs, quick repairs are currently not possible and the cost for one hour downtime of a support ship can be up to US $17,000.00.

In addition, the operating speed of the work unit is partly measured by standards based on well established pile driving work above water, resulting in costs which, for underwater work, are not commensurate with the derived benefits. The deeper the operation, the more time is required for handling compared with the pile driving operation itself. The investment for the drive unit must therefore bear a balanced, different relation to work above water.

Further, the expensive underwater equipment components are, in fact, utilized only rarely and then only for short time periods and should offer more diverse use, so that they can be amortized more quickly. Therefore, in view of the increasing need for economy in this established underwater technology, the current state of the art is no longer adequate.

DE-PS 30 07 103 discloses a drive unit which is located on or next to the housing of an impact hammer.

This drive unit consists of an electric or hydraulic motor and a pump. It does not have a pressure medium tank, but is connected with the fluid filled housing of the impact hammer. The fluid in this housing is simultaneously used as the drive fluid for the ram hammer and is pressurized by the pump. The pump and motor form a part of the hammer unit which is rigidly attached to the hammer housing. Advantageously, the pump with motor including all conduits is installed in the head of the hammer housing. An arrangement next to the hammer housing is not further explained. This drive unit, unlike previously described units, is not designed as a self contained drivable unit because it lacks a pressure medium tank, unless the surrounding water is used as the drive fluid which can restrict its operation depending on the degree of water fouling.

In addition, this design demonstrates some of the previously described disadvantages, i.e. the fixed connection of drive unit and supply line can only be disconnected onboard, access to the pressure medium cylinder etc. is obstructed and, because the connection is fixed and rigid, the handling risks to the supply lines described above and to the unprotected motor/pump unit apply.

The state of the art outlined above describes problems and/or wishes dealing with the drive unit itself and with other components or circumstances all of which inhibit, already for some time and increasingly so, the economic use of underwater drive units for the energy efficient operation of pile drivers and work units.

SUMMARY OF THE INVENTION

It is an object of the present invention to provide a submersible drive unit of the kind mentioned in the beginning which is of lightweight construction, can be quickly repaired even to the extent of replacing of drive components, can be quickly separated from the pile driver or work unit, can be safely handled with or without umbilical, can be utilized more diversely and finally, is designed economically.

To solve these tasks, a drive unit according to the present invention is disclosed in which the submersible drive unit is connectable with a drive of a submersible work unit, and has at least one electric motor connected to a support ship by way of an umbilical for transmitting electric energy to the electric motor, and at least one pressure medium pump connected to and driven by the electric motor and in fluid communication with a pressure medium tank. The drive unit also has a coupling to receive a foot piece of the electric motor, a first flange coupled to the pressure medium pump, and a second flange coupled to the pressure medium tank. The combination forms a self-supporting structure for the drive unit.

This drive unit is characterized by lightweight construction and quickly detachable individual components. Further, it is self supporting and does not require an extensive structural frame for connection with the pile driver or work unit. The electric motor/pressure medium pump units are exchangeable with little effort for more or less powerful units. By way of modular construction, several drive units can easily be combined to obtain a larger drive unit, and conversely, by taking away modular units smaller drive units can be obtained in many different combinations as required. By incorporating suitable connection means, the drive unit is prepared for detachment from pile drivers and work units above and below water and can therefore, by virtue of its design, be handled gently as an independent unit, with and without umbilical, separate from the pile driver or work unit.

The latter has the advantage that, in case of damage, the work unit can remain outboard and only the drive unit may be taken onboard if necessary, or the drive unit can be hoisted up full speed, inspected and lowered again. In the past, it can only be hoisted up slowly together with the rigidly connected pile driver or work unit, and lowered especially slowly, if work unit components have to be pressurized internally with air to compensate for the external water pressure.

Because of simpler and gentler handling, more economically designed drive energy and elimination of redundant spare lines, a more cost effective umbilical can be used or, depending on operating procedure, one can now use, in place of an expensive umbilical, a more cost effective one or a single cable may be sufficient. Since the drive unit proposed above is significantly lighter, one can now also utilize for a single or a few drive units a moderately reinforced umbilical or cable designed to carry only tensile forces, simultaneously serving as a lifting element, thereby obviating the need for a lifting rope.

These proposed solutions lead to altogether improved interchangeability of individual drive components, the drive unit itself including elements connected with it, as well as improved repairability.

The installation according to the invention has a better chance for more cost effective operation because of lower equipment cost and greater safety and therefore makes it also possible to operate in greater water depths at bearable costs when combined with suitably equipped submersible pile drivers and work units.

Additional design variations of this drive unit are described in the claims. Preferred design examples are described below and shown in the corresponding drawings.

DETAILED DESCRIPTION OF THE PREFERRED EMBODIMENT

Figure 1:
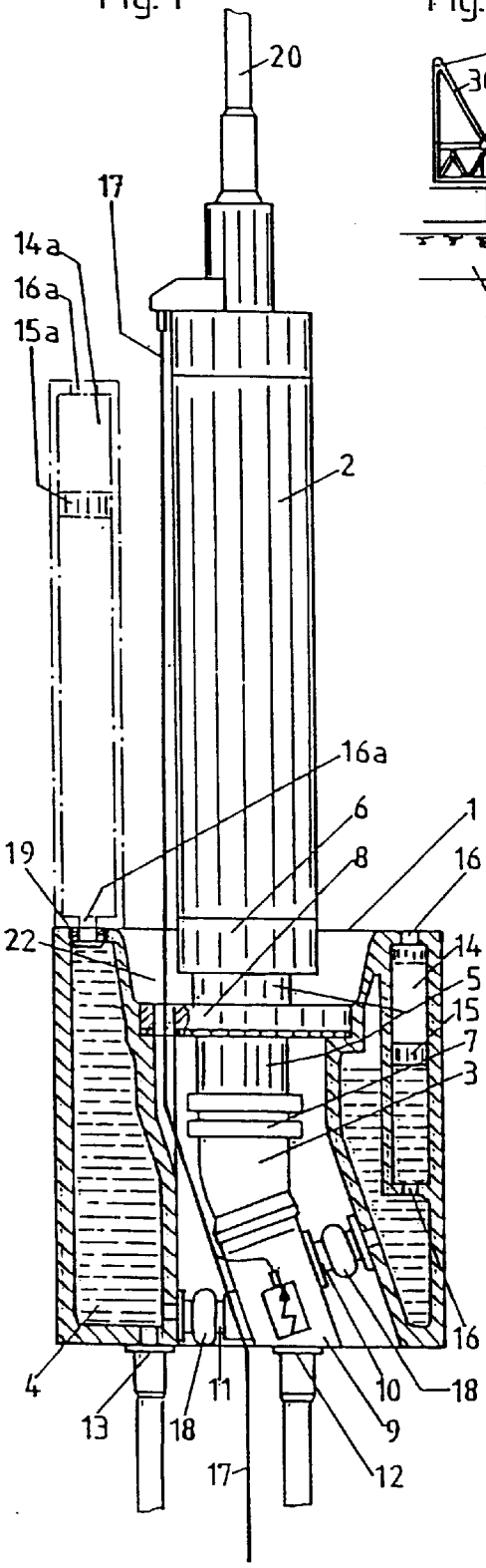
FIG. 1 shows schematically a drive unit with underwater electric motor and pressure medium pump in elevation as well as pressure medium tank in longitudinal section.

Drive unit 1 shown in FIG. 1 consists of an underwater electric motor 2, a pressure medium pump 3 and a pressure medium tank 4. These components are connected to each other by means of coupling 5 to make up a drive unit: The pedestal of electric motor 2 with its foot piece 6 at its upper end, hydraulic pump 3 with flange 7 at its lower end and pressure medium tank 4 at its flange 8. The components connected to each other in this manner are self supporting, thus obviating the need for an additional frame.

A valve block 9 is attached to the pressure medium pump 3 for the required operating controls. Pressure medium flows from connector 10 through valve block 9 to pressure medium pump 3 and then flows pressureless either completely or partially back to the pressure medium tank 4 through connector 11, or flows either completely or partially through connector 12 to the work unit and back to pressure medium tank 4 through connector 13. An equalizing cylinder 14 with floating piston 15 is, through openings 16, in contact with the external water on one side and with the pressure medium on the other. It ensures pressure equilibrium in pressure medium tank 4 with respect to the external water pressure.

Energy is supplied through umbilical drive unit 1 is lightweight. The cement since the drive unit 1 is lightweight. The control line 17 extends from the umbilical 20 or is a separate line coming from above and continues on to the equipment.

The connections 10 and 11 are designed with compensators 18 which compensate for offsets and length differences between the connections of the pressure medium pump 3 and the pressure medium tank 4, facilitating quick installation. Similarly, flange 8 is shimmed with a slightly elastic and flexible material in order to dampen shocks to the electric motor 2 and to bridge machining tolerances between connecting surfaces for lines 12 and 13 when, instead of these, couplings with machined surfaces are used to ensure leak tight connections. See FIGS. 6, 9, 10, 12 and 15. The pressure medium tank 4 can be extremely small because its design is such that the pressure medium is cooled over a large surface by the external water whose temperature is only approximately +5° C. in the water depths where the work is to be performed. If required, the surface area can be increased through appropriate design of the pressure medium tank 4, e.g. by increasing the height and decreasing the outer diameter, or by means of cooling fins rather than by increasing the volume of the pressure medium. The pressure medium volume has to be just large enough to ensure good flow conditions to pressure medium pump 3.

Depending on operating conditions, the pressure medium volume in the pressure medium tank 4 can vary greatly and differently. However, since conditions differ from case to case depending on, e.g., water depth, design of pile driver or design of work unit, the equalizing cylinder 14 is designed for only the most common conditions so that an economical design can be obtained.

For use in deep water or with equipment with larger pressure medium accumulator capacities, as required e.g. for smoothing out unsteady pressure medium flow during oscillating movements of the lifting cylinder of pile drivers, it is possible to attach an additional equalizing cylinder 14*a* as shown in dashed lines.

Instead of the plug 19, the equalizing cylinder 14*a* is installed. It communicates through openings 16*a* with the pressure medium tank 4 and with the external water and has a floating piston 15*a*. When using equalizing cylinder 14*a*, piston 15 of the regular equalizing cylinder 14 is pushed against the upper stop by the higher oil column. It will be activated again when all pressure medium has escaped from the equalizing cylinder 14. It serves as a standby for this emergency.

In order to utilize the pressure medium tank 4 in more diverse applications and therefore more economically, the opening 22 for coupling 5 with pressure medium pump 3 is made larger so that an underwater electric motor 2 and a pressure medium pump 3 with greater power, i.e. with greater diameter can also be installed. In this case it is also useful to have the possibility of adding an additional equalizing cylinder 14*a,* so that a larger quantity of pressure medium is available corresponding with the larger intake volume of the pressure medium pump 3. Otherwise a larger pressure medium tank 4 would be required.

The pressure medium tank 4 is the base structure to which all drive components are attached. Since it is designed ruggedly to cope with rough offshore conditions, it need not be strengthened any further to cope with this function and can be adapted without great additional costs, and the result is a self supporting drive unit, making a support frame superfluous.

Figure 2:
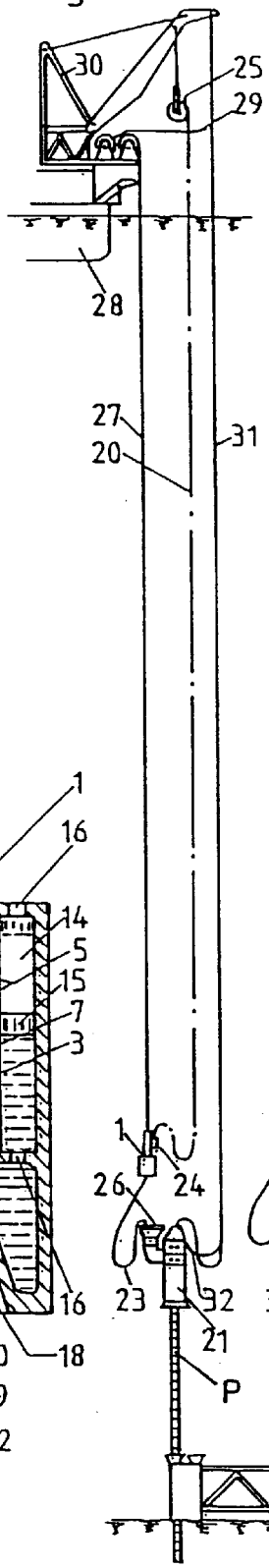
FIG. 2 shows schematically a vibration pile driver connected with a support vessel by way of a drive unit and placed on top of a foundation pile of an underwater structure.

FIG. 2 shows an example where a vibration pile driver 21 is placed free standing on top of a foundation pile P and is connected by means of short lines 23 to the drive unit 1 which is suspended from the lifting rope 27, and is connected with umbilical 20, guide pulley 25 and hoist 29 to the support ship 28 for supply of energy, control signal and compressed air. Because of the light weight of the drive unit 1, the umbilical 20 or a suitably tension reinforced simple electric power cable can be advantageously utilized in place of the lifting rope 27, as already described before.

The drive unit 1 is detachable from the umbilical 20 by means of the electric power cable and control line plug connector 24, and from the vibration pile driver 21 by means of the pressure medium and control line plug connection 26 situated on one side of the vibration pile driver 21, and can therefore be handled gently as an independent unit. The vibration pile driver 21 is lowered and raised by crane 30 using lifting rope 31. Compressed air is supplied separately from the support vessel 28 through line 16.

Figure 3:
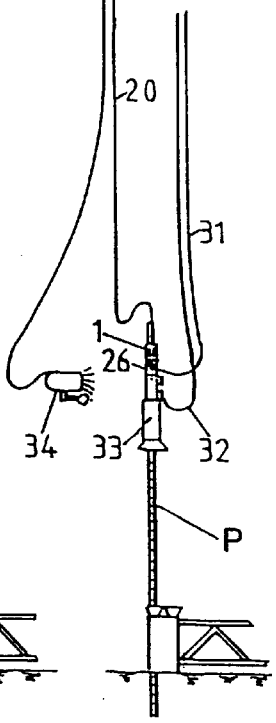
FIG. 3 shows a detail, similar to FIG. 2, of a pile driver with a coaxially placed drive unit.

FIG. 3 shows another application example where the drive unit 1 is placed directly and coaxially on the head of a pile driver 33 and connected detachably with it by means of a plug connection 26. The umbilical 20 is also the lifting element for the drive unit An underwater vehicle 34 with television camera and robotic tools assists in this and the other examples in connecting and detaching plug connection 26 as well as in observing the umbilical 20, the lifting rope 31 and the compressed air line 32 during operation.

Figure 4:
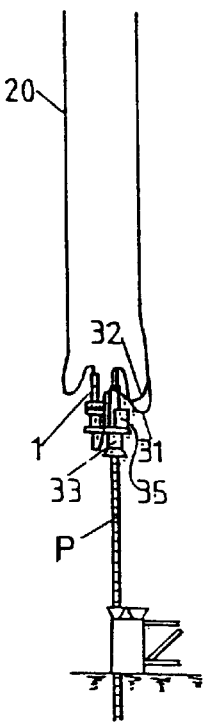
FIG. 4 shows a detail, similar to FIG. 3, however with a drive unit placed off center.

FIG. 4 shows a drive unit 1, again directly connected with the pile driver 33, but at the side. Depending on power requirements, one or more will be arranged around the pile driver 33 and connected with it. A weight imbalance will be compensated for by a counterweight 35.

Figure 5:
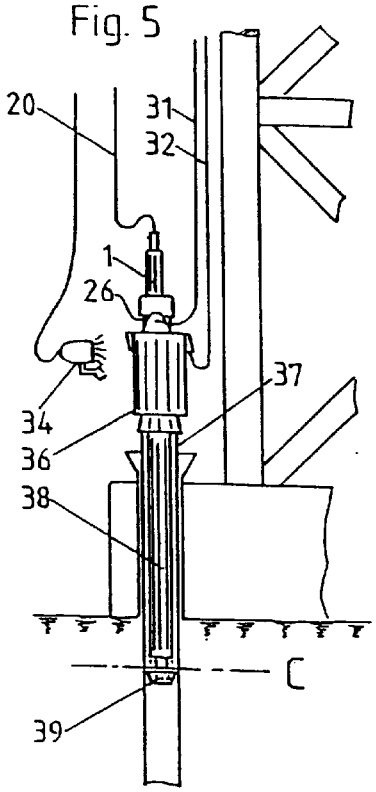
FIG. 5 shows schematically cut-off equipment placed on top of an installed foundation pile of an underwater structure.

Corresponding with the diverse application possibilities, FIG. 5 shows underwater cut-off equipment 36 which is placed on top of a driven foundation pipe pile 37 and whose shaft 38 with the cut-off tool 39 protrudes into it, so that it can be cut off below the sea floor in section C. The cut-off equipment 36 is driven by a coaxially installed, electrically driven underwater drive unit 1, which is also detachably connected to it by means of a plug connection 26. The umbilical 20 supplies electric energy and simultaneously serves as the lifting element.

Figure 6:
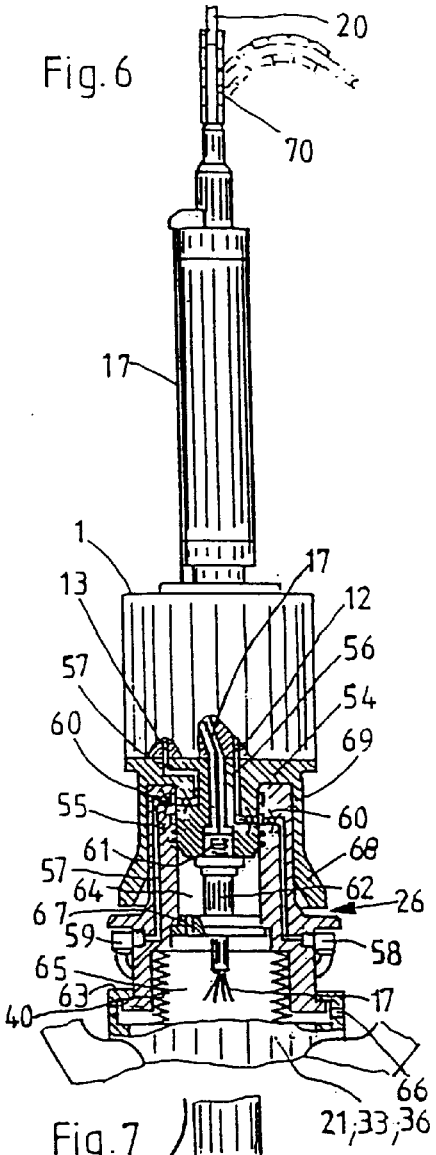
FIG. 6 shows the drive unit according to FIG. 1 in elevation with a plug connection coaxially connected on top of a pile driver or work unit.

In FIG. 6, the drive unit 1 is installed directly and coaxially on top of the work unit (21, 33 or 36) by means of the pressure medium and control line plug connection 26, with connections 12 and 13 coinciding with connections 56 and 57, respectively, of the plug connection 26. It can be connected wet or dry.

The plug connection 26 consists of a plug part 54 bolted to drive unit 1 and the socket part 55. The plug part 54 contains pressure medium channels 56 and 57 which pass through socket part 55 and terminate in hose connections 58 and 59 through which pressure medium flows to and from the work unit. The channels are equipped with check valves 60 which prevent oil from escaping and water from entering the systems when unplugged.

The control lines 17 are connected in the plug part 54 to a coaxial, wet-connectable electric socket 61, whose plug 62 is located in socket part 55, and which connects control lines 17 with the work unit. The support of socket 61 is preferably laterally displaceable in the transverse direction in order to avoid problems caused by off-centering when connecting parts 54 and 55.

Electric plug connection 61/62 and pressure medium plug connection 54/55 are made simultaneously.

For work units 21, 33 which are subject to vibrations, the socket part 55 may be mounted in a flange ring 63 and spring loaded with a spring 40.

The plug connection is plugged together by the own weight of the drive unit 1. As spaces 64 and 65 become smaller during plugging in, or fluctuate in size because of spring action, the displaced water escapes through openings 66 and 67.

In order to avoid damage to the sealing surface on plug part 54, a protective skirt 69 is provided which has a large guide cone 68 on its lower end facilitating plugging parts 54 and 55 together.

The lifting element is the umbilical 20 itself which is protected against excessive bending by a moment resisting sleeve 70. It must be capable of unplugging part 54 by overcoming the small forces due to indentation connections. Otherwise a lifting rope will be used.

Figure 7:
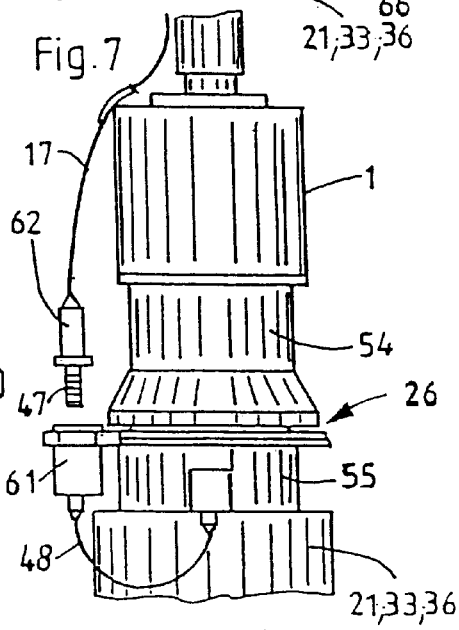
FIG. 7 shows a partial view of FIG. 6 with a control line and electric plug connection external to the plug connection that connects the drive unit.

FIG. 7 shows a design according to FIG. 6, where the electric socket part 61 with plug 62 for control cable 17 is relocated to the outside and is connected to the work unit 21,33,36 through line 48, thereby simplifying the interior of plug connection 26. Since parts 61 and 62 are connected to spring loaded socket part 55, the former are also spring loaded.

The coaxial cylindrical pin of plug part 62 has as many contact rings 47 as there are signals to be transmitted, provided there are no facilities for data processing and transmission on work unit 21,33,36 that allow several different signals to be transmitted through a single ring contact 47.

If control line 17 contains a compressed air line, then compressed air can be transmitted through the hollow plug part 62 and a correspondingly designed socket 61 to the work unit. In this case, check valves 60 are to be provided in both parts as described in FIG. 6.

Plug 62 is plugged in by the underwater vehicle 34 and unplugged together with the drive unit 1 during unplugging of plug connection 26 by pulling on the umbilical 20. If required, the plug connection parts 61/62 can be locked together, e.g. similar to FIG. 10 and FIG. 11.

Figure 8:
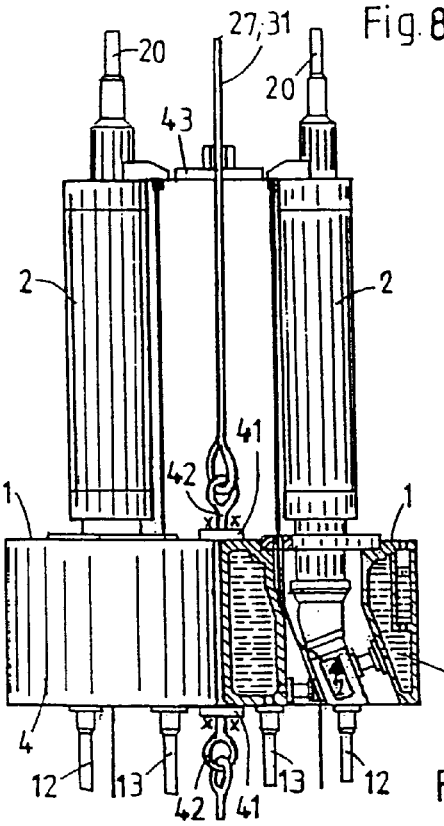
FIG. 8 shows schematically two drive units connected with each other.

FIG. 8 shows two interconnected drive units 1 each of which is supplied with energy by an umbilical 20 or a simple electric power cable, supplying the generated pressure medium flow through their own lines 12 and 13 to the pile driver or work unit. The pressure medium tanks are bolted to each other by means of simple load bearing plates 41 with lifting hooks 42 for lifting ropes. The underwater electric motors 2 are additionally connected with each other by a spacer plate 43 which is also used as a guide for the lifting rope 31.

Figure 9:
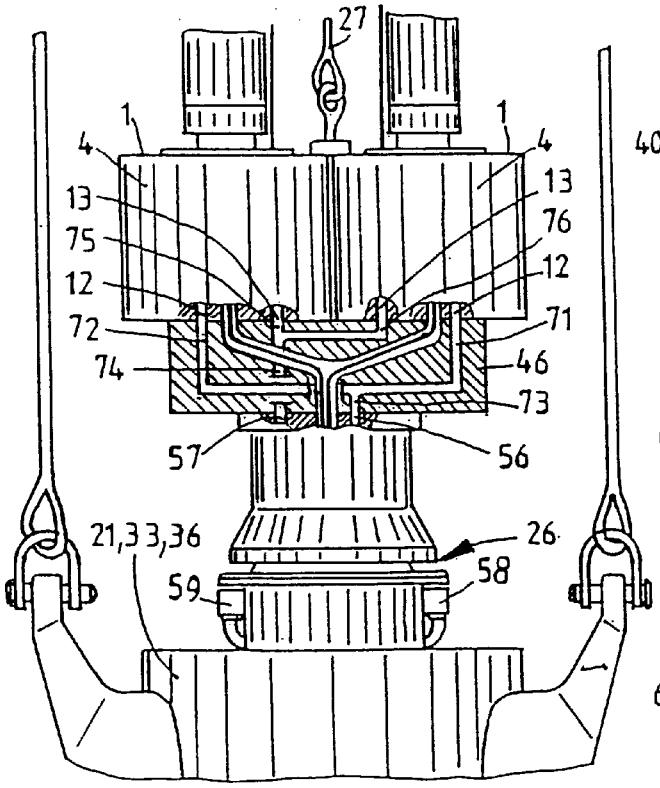
FIG. 9 shows a partial view of two interconnected drive units with a plug connection connected on the top end of the pile driver or work unit.

In FIG. 9 two interconnected drive units 1 are connected to the top of the work unit (21,33,36) by means of a distributor piece 46 and the pressure medium and control line plug connection 26, whereby connections 12 and 13 coincide with connections 71 and 76, and 72 and 75, respectively. The distributor piece 46 combines pressure medium coming from the pressure medium pumps of drive units 1 in channels 71 and 72 into channel 73 and feeds it through channel 56 and through plug connection 26 to the work unit (21,33,36). Pressure medium coming from the latter through channel 57 to channel 74 and distributed to channels 75 and 76 is returned to the pressure medium tanks 4 of the two drive units 1.

Figure 10:
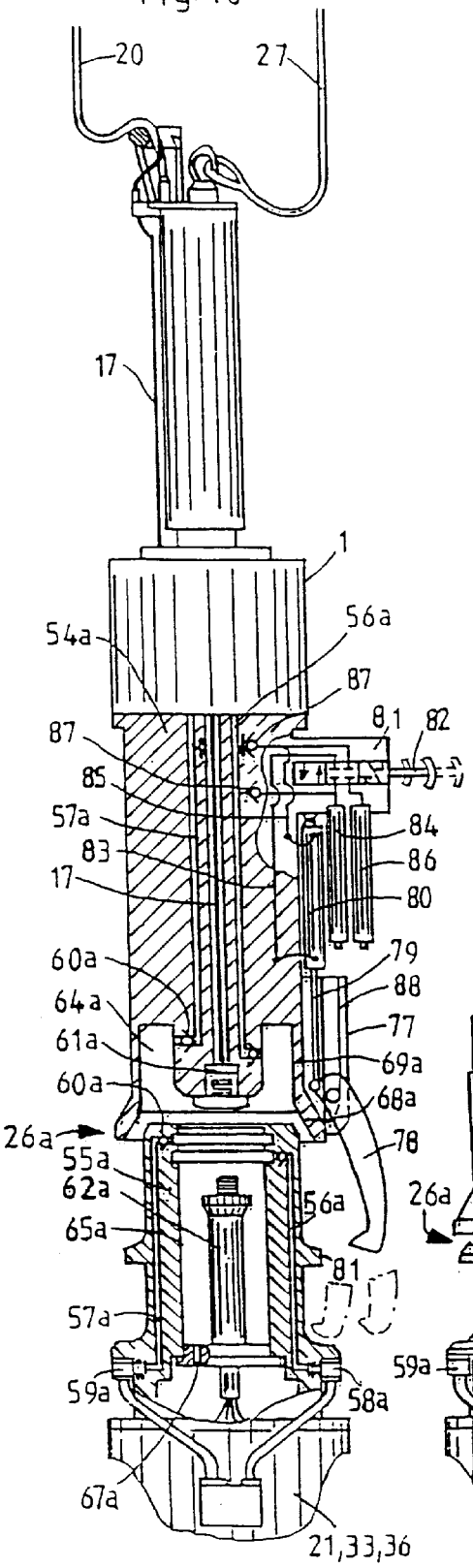
FIG. 10 shows a representation similar to FIG. 6 with a lockable plug connection.

FIG. 10 shows, in contrast to FIG. 6, a pressure medium and control line plug connection 26*a* with a locking device 77 which simultaneously serves as a pulling device assisting in securely plugging the two parts together. The parts 54*a* to 69*a* of plug connection 26*a* correspond functionally with those of plug connection 26 of FIG. 6. They are therefore not described again.

The plug connection 26*a* is shown just before the plugging operation. The socket part 55*a* is already engaging the guide cone 68*a* of plug part 54*a* and the locking hook 78 is about to swivel and hook on below shoulder 81 as piston rod 79 of cylinder 80 is retracted. As piston rod 79 is retracted further, part 54*a* together with drive unit 1 and part 55*a*, and simultaneously electric socket parts 61*a* and 62*a*, are pulled together by the locking book 78 which rides in guide 88, and which finally firmly tensions them together, unless the weight of drive unit 1 is sufficient to effect this process alone. Since the contact areas are pressed together, any torque created during starting and running of the electric motor is absorbed by friction in the contact areas.

The locking mechanism 77 is actuated by control valve 81 whose control rod 82 is manipulated underwater by underwater vehicle 34 or other suitable means. In order to retract piston rod 79 pressure medium is sent from the high pressure accumulator 84 to the lower chamber of cylinder 80 through line 83, while simultaneously the displaced hydraulic fluid from the upper chamber of cylinder 80 is sent through line 85 to the low pressure accumulator 86.

Unlocking occurs through a spring (not shown) located, e.g., in the upper chamber of cylinder 80 pushing the piston rod 79 in the initial position; simultaneously lines 83 and 85 are connected with the low pressure accumulator 86 through the control valve 81 which allows pressure medium to be transferred to the upper chamber.

If there is insufficient pressure medium in accumulators 84 and 86, i.e. if pressure falls below the lower threshold, it is replenished through check valves 87 from the pressure medium circuit. Conversely, an excess of pressure medium is released from the accumulators 84 or 86 to the pressure medium circuit through relief valves (not shown).

The check valves 87 are placed in the pressure medium circuit of the work unit (21,33,36), as functionally required: For the high pressure accumulators 84 in pressure channel 56*a*, and for the low pressure accumulator 86 in return channel 57*a*.

The drive energy is supplied by means of the umbilical 20 or separate electric power cables and control lines.

If required, a spring 40 as shown in FIG. 6 can be included in this plug connector also.

Figure 11:
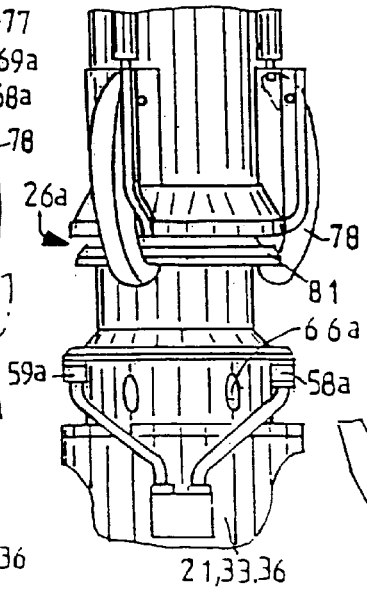
FIG. 11 shows a partial view of representation according to FIG. 10 with locked plug connection.

FIG. 11 shows a partial view of plug connection 26*a* with locking hooks 78 of which there are three distributed on the circumference to ensure uniform pull and clamping force, and also friction force to counteract torque created during starting and running of the underwater electric motors.

Figure 12:
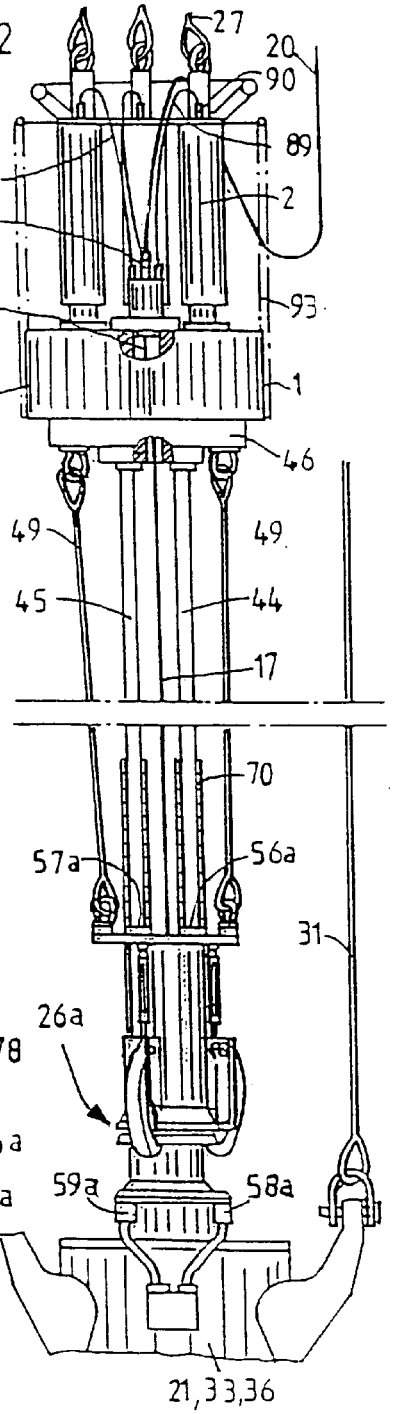
FIG. 12 shows schematically three interconnected drive units which are connected with the underwater equipment by means of lines.

The three drive units 1 shown in FIG. 12, interconnected to produce greater drive energy, are detachably connected with the work unit (21,33,36) by means of a distributor piece 46 as described in FIG. 9, pressure medium lines 44 and 45, control line 17 and plug connection 26*a*. The pressure medium lines 44 and 45 supply and return, respectively, pressure medium to and from work unit (21,33,36) by means of channels 56*a*, 58*a* and 59*a*, 57*a*, respectively.

The electric energy is supplied by the umbilical 20 to the electric power and control line plug connection 24, from where it is distributed to the underwater electric motor 2 of each drive unit 1 by means of lines 89 with plug 90. The control line 17 is also connected to plug connection 24.

The drive units 1 with plug connection 26*a* are raised and lowered by lifting ropes 49 and 27 and, after unplugging plug connection 26*a*, can be handled as one single package, separately from the work unit (21,33,36).

Figure 13:
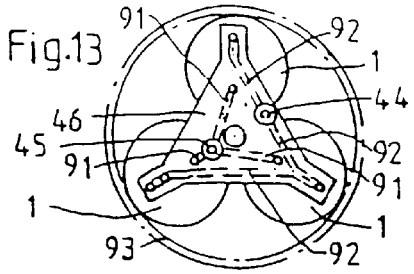
FIG. 13 shows the three drive units, according to FIG. 12, from below.

FIG. 13 shows how channels 92 and 91 are arranged in distributor piece 46, collecting pressure medium from drive units 1 to connector 44, or distributing returning pressure medium from connector 45 to drive units 1. Also, channels 91, by virtue of being interconnected and connected with pressure medium tanks 4 of drive units 1, ensure that pressure medium tanks 4 are communicating pressure medium.

Additionally, each individual drive unit 1 is connected to the distributor piece 46. It firmly connects them to each other to form a single unit. If distributor piece 46 is extended outwardly, it can also serve as the base for the protective skirt 93 indicated by dashed lines.

The distributor piece 46 contributes significantly to the desired light weight and economic design of the installation.

Figure 14:
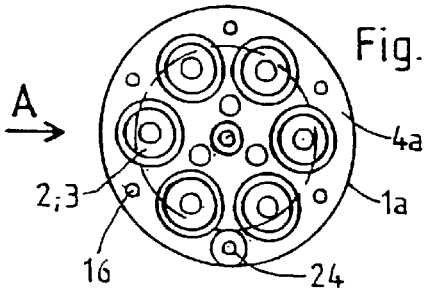
FIG. 14 shows schematically a larger drive unit with six electric motor/pump units and a pressure medium tank.

FIG. 14 shows, in contrast to FIG. 13, how a larger drive unit 1*a* is not composed of several smaller units 1 with their own pressure medium tanks 4 to form a larger unit, but rather how a single large pressure medium tank 4*a* is equipped with several electric motor and pump units 2 and 3, respectively, to establish one large drive unit. This design variation has advantages since it can be built smaller in diameter and lighter in weight than those composed of several complete single units 1, depending on size and number of installed electric motor/pump units.

The pressure medium tank 4*a* also includes equalizing cylinders 14, described in FIG. 1, located in spaces between electric motor and pump units, 2 and 3, respectively, which communicate with the external water through openings 16.

The required plug connector 24 for connecting electric power and control lines with drive unit 1*a* is located in such a space also. Additional equalizing cylinders 14 can be installed as indicated.

Figure 15:
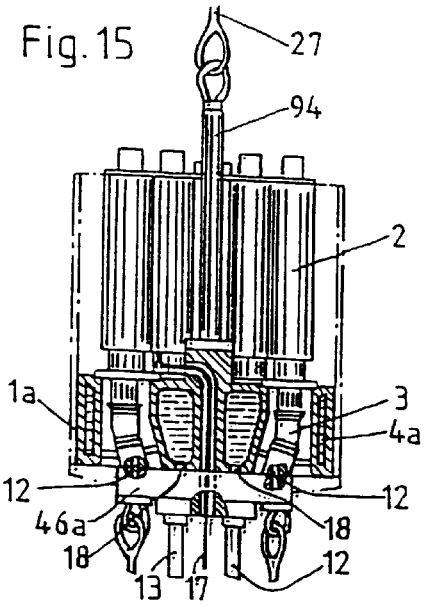
FIG. 15 shows the drive unit according to FIG. 14 in side view with the pressure medium tank in longitudinal section.

Preassembled electric motor/pump units 2 and 3, respectively, are installed in pressure medium tank 4*a* shown in FIG. 15 in the same way as single units are installed as shown in FIG. 1.

This type of drive unit 1*a* for pile drivers and work units with its greater power output is flexible in that it can be equipped with a different number of electric motor/pump units each having the same or different power output.

When spaces remain empty, connections 18 on pressure medium tank 4*a* and connections 12 on distributor piece 46*a* will be plugged in. The drive unit 1*a* offers economy and value based on its potential for different applications, low construction size and light weight as well as its handling separate from work units.

The proposed principle of a self supporting drive unit is unchanged. The pressure medium tank 4*a* is in this case also the load bearing building block of the drive unit 1*a*. If required several drive units 1*a* can interconnected in a similar fashion as drive unit 1 to establish even larger units.

The function of the distributor piece 46*a* as described in FIG. 9 is one of collecting and distributing pressure medium from the drive unit to the pile driver or work unit and returning it from same to the drive unit by means of internal, suitably arranged channels. The distributor piece 46*a* is circular for compact construction and connects drive unit 1*a* with pile driver or work unit by means of pressure medium lines 12 and 13 and control line 17.

A bracket 94 is connected to pressure medium tank 4*a* in order to connect lifting rope 27 above the electric motors 2.

Figure 16:
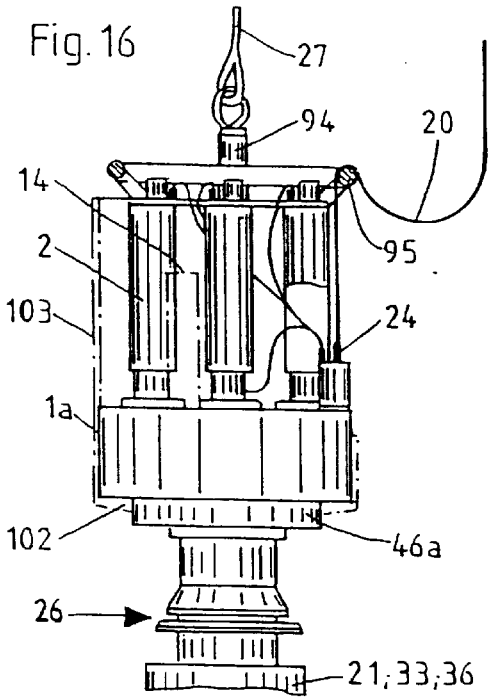
FIG. 16 shows the drive unit according to FIG. 14 in side view looking in the direction of arrow "A" (see FIG. 14).

FIG. 16 shows an elevation of drive unit 1*a*, in contrast to FIG. 15, with a pressure medium and control line plug connector 24 for direct connection with pile driver or work unit 21, 33,36. The umbilical 20, resting on ring 95, terminates in plug connection 24 as already described in FIG. 12.

An additional equalizing cylinder 14 is shown in dashed lines.

The extension pieces 102, shown in dashed lines on the circumference of distributor piece 46*a*, can also be used for attaching the protective skirt 103 shown in dashed lines. The same applies to distributor piece 46 described under FIG. 9.

Figure 17:
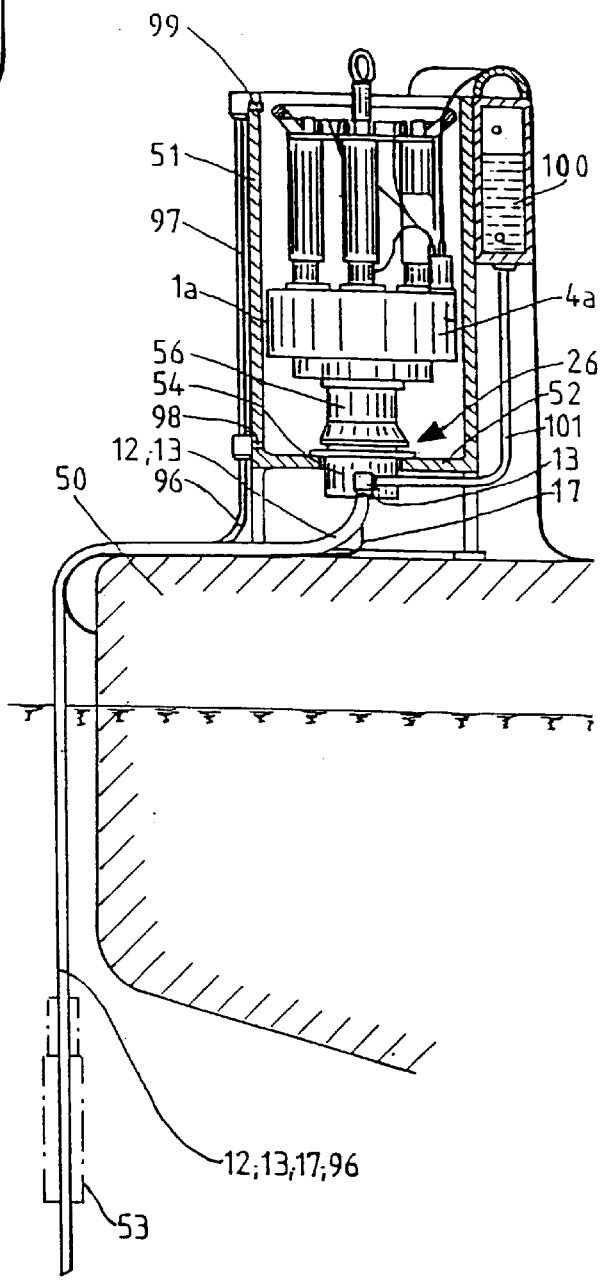
FIG. 17 shows a schematic representation of a drive unit located in a cooling tank with additional pressure medium tank onboard a support vessel.

FIG. 17 shows drive unit 1*a*, shown in FIG. 16, on the deck of a support ship 50 and installed inside a simple piece of pipe 51, set up to drive a pile driver or work unit located underwater by means of pressure medium lines 12, 13 and control line 17.

In this pipe piece 51, the socket part 55 of a plug connection 26 is rigidly attached to the pipe bottom 52 to which lines 12, 13 are connected. When the drive unit 1*a* is installed and made operational, it merely has to be lowered into pipe piece 51, with its plug part 54 set into the socket part 55, or to be lifted out for immediate use elsewhere. Extensive assembly work including line connections using plug connections or bolted connections is unnecessary, and set up costs are minor. For cooling the drive unit 19 cooling water is either pumped through lines 96, 97 on deck of the support ship 50 into the pipe piece 51 through opening 98 and returned through opening 99 for recooling, or pumped from the ocean by means of a submersible pump 53 and returned to it.

Pressure medium lines 12, 13, depending on their length and diameter, may absorb such a large volume of pressure medium from the pressure medium tank 4*a* at the beginning of the operation that possibly even additional equalizing cylinders 14 cannot cover the demand. In that case, an auxiliary pressure medium tank 100 will be utilized supplying the required quantity of pressure medium and recovering it from the hoses when they are emptied. To this end this auxiliary tank 100 is connected with pressure medium tank 4*a* through line 101 and the connector 13.

In order to achieve good flow conditions for the pressure medium pump and a damping effect on the returning pressure medium during unsteady operation of the work unit, the auxiliary tank can be pressurized with air by a small amount over and above normal air pressure.

Instead of the drive unit 1*a*, other configurations of drive unit 1 can be set into the pipe piece and, instead of placing it on deck it can also be placed on the crane of the support ship.

One can also provide hose connections instead of the plug connection 26 and, compared with the current state of the art, these still save assembly time.

I claim:

1. A submersible drive unit connectable with a drive of a submersible work unit comprising:

at least one electric motor connected to a support ship by way of an umbilical for transmitting electric energy to the electric motor;

at least one pressure medium pump connected to and driven by the electric motor and in fluid communication with a pressure medium tank; and a coupling to receive a foot piece of the electric motor, a first flange coupled to the pressure medium pump, and a second flange coupled to the pressure medium tank thereby forming a self-supporting structure.

2. The submersible drive unit of claim 1 further comprising a valve block connected to the pressure medium pump to control pressure medium flow to the submersible work unit.

3. The submersible drive unit of claim 1 further comprising a floating piston in an equalizing cylinder, the equalizing cylinder having a first end in communication with the pressure medium tank and a second end in communication with external water pressure, thereby providing a pressure equilibrium in the pressure medium tank with respect to external water pressure.

4. The submersible drive unit of claim 3 wherein the equalizing cylinder has an opening at the first end providing fluid communication between the pressure medium tank and a first side of the floating piston, and an opening at the second end providing fluid communication between the external water and a second side of the floating piston.

5. The submersible drive unit of claim 1 wherein the second flange of the coupling is coupled in an elastic, flexible shim to dampen shocks to the electric motor.

6. The submersible drive unit of claim 1 further comprising a supply connection and a return connection between the pressure medium pump and the pressure medium tank, each connection having a compensator therein to compensate for machining tolerances and vibrations.

7. The submersible drive unit of claim 1 wherein the pressure medium tank is situated on an outer circumference of the submersible drive unit and has a majority of outer surface area in contact with water when submerged for cooling and therefore is relatively small in comparison to the amount of pressure medium pumped.

8. The submersible drive unit of claim 3 further comprising a second equalizing cylinder and piston assembly in communication with the pressure medium tank and external water.

9. The submersible drive unit of claim 1 further comprising at least a pair of connectors for remotely wet-connecting the submersible drive unit to the work unit.

10. The submersible drive unit of claim 1 further comprising a wet-detachable plug connection for mounting the submersible drive unit directly to the work unit.

11. The submersible drive unit of claim 10 wherein the submersible drive unit is coaxially mounted to the work unit.

12. The submersible drive unit of claim 10 wherein the wet-detachable plug connection comprises a plug part and socket part, each having corresponding pressure medium channels terminating at hose connections in the socket part for communicating pressure medium to and from the work unit.

13. The submersible drive unit of claim 12 where the pressure medium channels have check valves therein to prevent pressure medium from escaping and water from entering the submersible drive unit when the plug part is disengaged from the socket part.

14. The submersible drive unit of claim 10 further comprising a wet-connectable electric socket and plug for the transmission of control signals.

15. The submersible drive unit of claim 10 further comprising a locking mechanism for locking the detachable plug connection.

16. The submersible drive unit of claim 1 further comprising:

a second electric motor connected to a support ship by way of the umbilical for transmitting electric energy to the electric motor;

a second pressure medium pump connected to and driven by the electric motor and in fluid communication with a second pressure medium tank;

a second coupling to receive a foot piece of the second electric motor, a first flange coupled to the second pressure medium pump, and a second flange coupled to the second pressure medium tank thereby forming a self-supporting structure; and wherein the pressure medium tanks are connected to form a submersible multiple drive unit assembly.

17. The submersible multiple drive unit assembly of claim 16 wherein a pair of load bearing plates connect the pressure medium tanks.

18. The submersible multiple drive unit assembly of claim 17 wherein the load bearing plates are bolted to each of the pressure medium tanks.

19. The submersible multiple drive unit assembly of claim 17 wherein the load bearing plates have a lifting hook to which lifting ropes are connected for moving the submersible multiple drive unit assembly.

20. The submersible multiple drive unit assembly of claim 16 wherein the electric motors are connected with a spacer plate.

21. The submersible multiple drive unit assembly of claim 20 wherein the spacer plate has a guide through which a lifting rope is attached to the submersible multiple drive unit assembly.

22. The submersible multiple drive unit assembly of claim 16 further comprising a distributor piece connected to a lower end of the pressure medium tanks wherein the distributor piece combines pressure medium from each pressure medium pump and conveys the pressure medium to the work unit.

23. The submersible drive unit of claim 1 wherein a plurality of electric motors are connected to a plurality of pressure medium pumps, and each pressure medium pump is connected to a single pressure medium tank.

24. The submersible drive unit of claim 23 further comprising a plurality of equalizing cylinders in communication with the single pressure medium tank and with external water pressure.

25. The submersible drive unit of claim 1 wherein the submersible drive unit is rigidly mounted in a housing assembly for operation on the support ship, wherein the housing assembly is equipped to receive cooling water from an external source and is further provided with an auxiliary pressure medium tank connected to the pressure medium tank of the submersible drive unit.

26. The submersible drive unit of claim 1 wherein the pressure medium tank acts as a load bearing structural member of the submersible drive unit.

* * * * *